US005464545A

United States Patent [19]

Isharani et al.

[11] Patent Number: 5,464,545

[45] Date of Patent: Nov. 7, 1995

[54] USE OF REVERSE-WATER-SOLUBLE POLYMERS AS NON-FORMALDEHYDE-RELEASING BINDER RESINS FOR TEXTILE-FINISHES

[75] Inventors: Jayanti V. Isharani; James K. Raper, both of Greensboro; A. Donald Allen, Jr., High Point; John W. Middleton, Kernersville, all of N.C.

[73] Assignee: Ciba-Geigy Corporation, Tarrytown, N.Y.

[21] Appl. No.: 232,308

[22] Filed: Apr. 25, 1994

Related U.S. Application Data

[63] Continuation of Ser. No. 71,213, Jun. 2, 1993, abandoned, which is a continuation of Ser. No. 804,628, Dec. 9, 1991, abandoned, which is a continuation of Ser. No. 487,560, Mar. 2, 1990, abandoned.

[51] Int. Cl.[6] ..... D06M 13/00; D06M 15/00

[52] U.S. Cl. ..... 252/8.6; 252/8.75; 252/8.9; 8/115.54; 8/115.56; 427/393.1; 427/393.2; 427/393.3; 427/393.4

[58] Field of Search ..... 252/8.6, 8.75, 252/8.9; 8/115.54, 115.56; 427/393.1, 393.2, 393.3, 393.4

[56] References Cited

U.S. PATENT DOCUMENTS

| | | | |
|---|---|---|---|
| 3,790,344 | 2/1974 | Frickenhaus et al. | 8/560 |
| 4,053,440 | 10/1977 | Bonnet et al. | 525/130 |
| 4,118,538 | 10/1978 | Balland | 8/495 |
| 4,149,847 | 4/1979 | Balland | 8/552 |
| 4,164,535 | 8/1979 | Veaute | 525/123 |
| 4,441,883 | 4/1984 | Vavala | 8/929 |
| 4,689,159 | 8/1987 | Makashima | 252/8.6 |
| 4,722,966 | 2/1988 | Flakus | 524/840 |

FOREIGN PATENT DOCUMENTS

| | | | |
|---|---|---|---|
| 276999 | 8/1988 | European Pat. Off. | 252/8.6 |
| 1272870 | 10/1989 | Japan | 252/8.6 |

OTHER PUBLICATIONS

*Hawley's Condensed Chemical Dictionary,* 11th Ed. p. 19 1987.

Kirk–Othmer, 3rd edition vol. 8 p. 308 (1979).

Irgapadol AM bulletin (year unknown).

*Primary Examiner*—P. Achutamurthy
*Attorney, Agent, or Firm*—George R. Dohmann

[57] ABSTRACT

A method and compositions for textile finishing utilizing non-formaldehyde-releasing, reverse water-soluble polymers as binder resins for textile finishes. Textiles treated by the disclosed method. The present invention is advantageous for health and safety reasons because it utilizes binder resins which do not release formaldehyde into the local environment.

15 Claims, No Drawings

USE OF REVERSE-WATER-SOLUBLE POLYMERS AS NON-FORMALDEHYDE-RELEASING BINDER RESINS FOR TEXTILE-FINISHES

This application is a continuation, of application Ser. No. 08/071,213, filed Jun. 2, 1993, now abandoned, which is a continuation of Ser. No. 07/804,628 filed Dec. 9, 1991, now abandoned, which is a continuation of Ser. No. 07/487,560 filed Mar. 2, 1990 now abandoned.

A method and compositions for textile finishing utilizing non-formaldehyde-releasing, reverse-water-soluble polymers as binder resins for textile finishes. Textiles treated by the disclosed method.

In order to achieve laundering durability, textile finishes are typically applied with durable-press (D.P.) resins as binder resin. Essentially all commonly available D.P. resins are based on formaldehyde condensates or formaldehyde releasing adducts of nitrogenous compounds; such as: urea, urea/glyoxal, ethylene urea, melamine and related derivatives. Such binder resins have a serious deficiency in that they all can release formaldehyde to the local environment. Therefore, for health and safety reasons, the textile industry is trying very hard to eliminate the use of formaldehyde-releasing resins.

It has been discovered that certain polymers which exhibit reverse-water-solubility can be utilized to impart durability to a variety of performance-effect textile finishes.

The term performance-effect finish is used generically in this application to describe a variety of finishes that modify textile properties. The performance-effect finishes applied by the present method include, but are not limited to, soil-release agents, soil repellents, water-repellents, softeners, flame-retardants, anti-static agents, light stabilizers, hand modifiers and U.V. absorbers. These finishes can be applied by the inventive method to nearly any type of textile. However, the inventive method is particularly useful for knitted or woven cotton, wool, PES/cotton, polyester, polyamide (nylon), acrylics, rayon and acetate fabrics.

The term textile in this application is intended to refer any class textile material including fibers, yams, knitted and woven fabrics.

The polymers utilized in the present method all exhibit the property of reverse-water-solubility (RWS). The water-solubility of RWS polymers decreases as the temperature rises, resulting in water-insolubility or near water-insolubility at around 38° to 50° C. This change in water-solubility exhibits itself as a cloud point which is defined as the temperature at which an aqueous solution at 1% active forms an opaque dispersion or precipitate. Generally, RWS polymers of the present method will have a cloud point from about 20° C. to about 60° C. Preferably, the cloud point will be from about 30° C. to about 50° C.

The RWS polymers utilized in the present method contain water-soluble block segments which become less soluble above the cloud point. This is thought to occur because the block segment loses its water of hydration. Polymers containing poly(oxyalkylene) and/or cellulose ether block segments which exhibit reverse water solubility can be utilized in the present method. In addition to the poly(oxyalkylene) or cellulose ether block segments, the polymers utilized in the present method can contain linking groups which connect the poly(oxyalkylene) or cellulose ether segments. These linking groups include, but are not limited to, polyester, polyamide, polycarbonate, polyacrylate and polyurethane and mixtures thereof. The resulting polymers can be linear or branched.

The RWS polymers utilized in the present method include any reverse-water-soluble polymer that is at least 1% soluble in water at 20° C. and has a cloud point (at 1% actives) that is greater than 20° C. and less than 60° C. Linear or branched poly(oxyethylene) containing polyurethanes with the above solubility and cloud point properties are preferred.

An especially useful class of RWS polymers is the poly(oxyethylene)-poly(oxypropylene) adducts of poly-isocyanates. This class of RWS polymer is represented by formula (I).

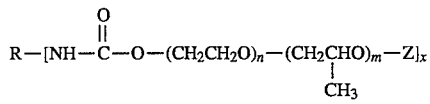

(I)

wherein R is the aliphatic or aromatic residue of a reactant containing 3 or more isocyanate reactive groups; each Z is independently hydrogen, $C_1$–$C_8$-alkyl or an additional R group; X is 3 or greater and the sum of m+n is 6 or greater;, with the proviso that there are enough poly(oxyethylene) residues to make the polymer soluble at 1% actives in water at room temperature.

In the instance when Z is an additional R group, the poly(oxyethylene)/poly(oxypropylene) block segments are, for example capped with another polyisocyanate where the additional isocyanate groups are reversibly blocked.

Compounds of formula (I) are obtained by the reaction of a polyisocyanate containing 3 or more —NCO groups per molecule with a mono-alcoholic-ether of a polyalkylene glycol (such as the product resulting from the addition of ethylene ! oxide and/or propylene oxide to an alcohol).

Examples of reactants containing 3 or more reactive isocyanate groups which form the residue R are polyphenylene polyisocyanate and hexamethylene-diisocyanate trimer. Polyphenylene polyisocyanate is represented by formula II wherein y is 3 or greater. Hexamethylene-diisocyanate trimer is represented by formula (III).

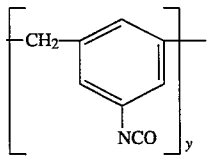

(II)

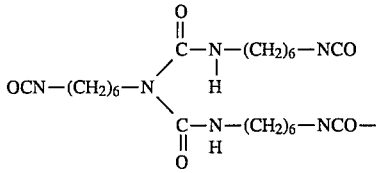

(III)

RWS polymers of formula (I) are preferably those in which x is 3 to 30, m is 0 to 100 and n is 5 to 500. Z is preferably $C_1$-$C_8$-alkyl and is most preferably butyl.

Poly(oxyethylene)-poly(oxypropylene) adducts of formula (I) wherein Z is butyl are known as thermosensitizers for aqueous dye dispersions which thermocoagulate dispersed dye particles to inhibit their migration during textile drying operations: Such alkoxylated-polyisocyanates are commercially available as MODAREZ (Societe' Protex-distributed in the U.S. by Synthron). These compounds are described in Chem. Abstr., 88:63182y (1977), and U.S. Pat. Nos. 4,164,535, 4,118,538 and 4,053,440, which are here incorporated by reference.

The invention is illustrated by but not limited to the following examples.

The following test methods were utilized in the examples are as follows:

Oil Repellency is evaluated by AATCC test method No. 130-1988. 0 is the worst rating (no oil repellency), and 8 is the best rating (high oil repellency).

Stain-Release is evaluated by the method published in 3M Scotchgard Stain-Release bulletins— "Stain-Release Method I" for resin treated apparel fabrics. Stain K=Kaydol® mine oil (Witco) Stain E=vegetable oil from 3M Stain C=15% dirty motor oil/85% 30W motor oil. 0 is the worst rating (no oily stain release during laundering), and 8 is the best rating. (complete stain release).

Wrinkle Recovery is a subjective visual rating test. A rating of 1 is worst. A rating of 5 is best. Used AATCC method No. 143-1988 ("Appearance of Apparel and Other Textile End Products after Repeated Home Laundering").

The following is a brief description of materials referred to in the following examples.

DICRYLAN BSR (CIBA-GEIGY) is 25% actives of a poly(oxyethylene) containing Reverse-Water-Soluble urethane-based polymer of the type described in formula (I) wherein the residue R is a polyphenylene polyisocyanate of formula II, and 0.75% of a naphthalene sulfonic acid condensate dispersant. The cloud point at 1% actives is 38° to 42° C.

SCOTCHGARD STAIN RELEASE FC-248 (3M Co.) is a perfluoroalkyl-acrylate-polyethylene oxide block co-polymer of the type described in U.S. Pat. Nos. 3,574,791 and 3,728,151.

ULTRATEX HX-33 (CIBA-GEIGY) and DOW CORNING 190 & 193—are hydrophilic silicone softeners of the type described in U.S. Pat. Nos. 3,402,192 and 4,818,421.

UCARSIL EPS—(UNION CARBIDE) is a similar silicone softener, but with an additional epoxide-functional side-chain (refer to article: A.J. Sabia & R.B. Melzer, NonwovensIndustry, Sept. 1983).

METHOCEL A15-LV (Dow) active methylcellulose. A stock solution is made up at 10% actives. The cloud point at 1% actives is about 60° C. heating up and about 35° C. cooling down.

PLURONIC L-63 (BASF) is a ethylene oxide-propylene oxide-ethylene oxide block copolymer. Stock solution made up at 10% actives. The cloud point at 1% actives is about 30° C.

AVIVAN PFS (CIBA-GEIGY) non-silicone textile softener based on a fatty acid mixture-polyamide condensation product.

AVIVAN HDP (CIBA-GEIGY) a polyethylene emulsion type textile softener.

PYROVATEX CP-NEW (CIBA-GEIGY) an organo-phosphorous type flame-retardant.

AEROTEX 3730 (AMERICAN CYANAMIDE) melamine-formaldehyde durable-press resin.

ULTRATEX MES (CIBA-GEIGY) amino-silicone based textile softener.

ALBAGAL BMD (CIBA-GEIGY) wetting & deaerating agent, polyglycol ether sulfuric acid ester salt ULTRATEX FR (CIBA-GEIGY) textile softener, mixture of polysiloxane and a fatty acid polyamide condensation product.

PERMAFRESH ULF (SEQUA CHEMICALS) modified imidazolidone durable-press resin.

KNITYEX PFR (CIBA-GEIGY) is a pre-catalized imidazolidone conventional glyoxal type durable-press resin.

EXAMPLE (1)

A non-formaldehyde-releasing binder for various textile finishes utilizing MODAREZ COU (Societe' Protex), a poly(oxyethylene) containing urethane-based polymer of the type described by formula (I) wherein R is based on formula (II), as the reverse-water-soluble polymer consists of an aqueous solution of 0.75% of naphthalene sulfonic acid condensate (for example TAMOL by Rohm and Haas) and 25% MODAREZ COU based upon the weight of the solids.

The above-described formulation is commercially available as DICRYLAN BSR (from CIBA-GEIGY) having the following typical properties:

| | |
|---|---|
| Appearance: | amber colored, viscous liquid |
| Ionic Nature: | Nonionic/anionic |
| Solids: | 26% (+/−10% relative) |
| pH (as is): | 7–9 |
| Boiling Point: | 212° F. |
| Solubility in Cold Water: | Miscible at all ratios |
| Cloud point (1% actives): | 38–42° C. |

EXAMPLE (2)

The following procedure was utilized to bind a stain-release agent to non-resinated knits and wovens. These knits can subsequently be compacted or napped.

A finishing formulation composed of

40–80 g/l DICRYLAN BSR 40 g/1AVIVAN PFS

20–40 g/1 SCOTCHGARD STAIN-RELEASE FC-248 was dispersed in cold water, pad applied to 60–70% wet pickup, dried at 300° F. and cured at 320°–340° F.

EXAMPLES (3)–( 11 )

The following finishing formulations were applied to 50/50 PES/CO red woven fabric to a wet-pickup of approximately 73%. The samples were dried at 300° F. for 2 minutes and cured for an additional minute at 350° F.

The samples were washed 5 times at 120° F. with 46 g of detergent (TIDE), dry tumbled for 45 minutes and tested for oil-repellency. Stain-release was tested on the initial and washed samples after 1 additional wash cycle at 120° F. with 100 g of detergent Each of the formulations is an aqueous formulation with the ingredients described in grams/liter of formulation.

| | (3) | (4) | (5) | (6) | (7) | (8) | (9) | (10) | (11) |
|---|---|---|---|---|---|---|---|---|---|
| DICRYLAN BSR | 40 | 40 | 40 | 40 | 40 | 40 | 40 | 40 | 40 |
| SCOTCHGARD FC-248 | 20 | 20 | 20 | 20 | 20 | 20 | 20 | 20 | 20 |
| ULTRATEX HX-33 (30%) | — | 30 | — | — | — | — | — | — | — |
| DOW CORNING 190 (99%) | — | — | 30 | 10 | — | — | — | — | — |
| DOW CORNING 193 (99%) | — | — | — | — | 30 | 10 | — | — | — |

-continued

| | (3) | (4) | (5) | (6) | (7) | (8) | (9) | (10) | (11) |
|---|---|---|---|---|---|---|---|---|---|
| UCARSIL EPS | — | — | — | — | — | — | 10 | — | — |
| AVIVAN PFS | — | — | — | — | — | — | — | 30 | — |
| AVIVAN HDP | — | — | — | — | — | — | — | — | 30 |
| Oil Repellency | | | | | | | | | |
| I | 3 | 1–2 | 1 | 1 | 1–2 | 2–3 | 0 | 2 | 2 |
| 5W | 0 | 0 | 0 | 0 | 0 | 0 | 0 | 0 | 0 |
| Stain-Release | | | | | | | | | |
| Stain K | | | | | | | | | |
| I | 6 | 5 | 5 | 6 | 5 | 6 | 6 | 6 | 5 |
| 5W | 6 | 6 | 5 | 6 | 5 | 5 | 6 | 7 | 6 |
| Stain E | | | | | | | | | |
| I | 5 | 5 | 4 | 5 | 4 | 5 | 4 | 7 | 6 |
| 5w | 5 | 6 | 6 | 6 | 6 | 6 | 6 | 6 | 3 |
| Wringle Recovery Performance | | | | | | | | | |
| I + 1W | 2 | 2 | 3 | 3 | 2 | 1 | 2 | 4 | 4 |
| 5W + 1W | 1 | 2 | 2 | 2 | 2 | 1 | 1 | 3 | 3 |

I is initial, 1w is after one wash and 5w is after five washes.

Examples (12) and (13)

The following formulations were applied to 100% cotton by padding with a wet pickup of 75%, dried at 280° F. and cured at 340° F. The treated material is then neutralized and rinsed.

Example (12) utilizes a conventional durable-press resin system. Example (13) utilizes a non-formaldehyde-releasing R.W.S. binder system as described in this application. All concentrations are in grams/liter of formulation.

| | (12) | (13) |
|---|---|---|
| FORMULATION | | |
| PYROVATEX CP | 400 | 400 |
| ALBEGAL BMD | 5 | 5 |
| ULTRATEX FR | 30 | 30 |
| PERMAFRESH ULF (GLYOXAL) | 80 | — |
| AEROTEX 3730 (MELAMINE) | 10 | — |
| DICRYLAN BSR | — | 80 |
| PHOSPHORIC ACID 85% | 20 | 20 |
| VERTICAL FLAME TEST 701 (NFPA TEST METHOD 701) AVERAGE OF 4 SAMPLES BURNED | | |
| INITIAL | 3.75 INCHES | 4.0 INCHES |
| AFTER 10 WASHES | 3.9 INCHES | 4.3 INCHES |
| AFTER 30 WASHES | 3.85 INCHES | 4.2 INCHES |
| AFTER RAPID AGEING | | |
| AATCC METHOD 26-1988 (Version 7.1.1) | 3.70 INCHES | 4.3 INCHES |
| AFTER RAPID AGEING + 1 WASH | 4.70 INCHES | 4.5 INCHES |
| MULLIN BURST ASTM METHOD D-3786 | | |
| CONTROL | >200 POUNDS/SQ IN | >200 POUNDS/SQ IN |
| INITIAL | 181 POUNDS/SQ IN | 191 POUNDS/SQ IN |
| AFTER 10 WASHES | 169 POUNDS/SQ IN | 183 POUNDS/SQ IN |
| AFTER 20 WASHES | 173 POUNDS/SQ IN | 177 POUNDS/SQ IN |
| AFTER RAPID AGEING + 1 WASH | 144 POUNDS/SQ IN | 147 POUNDS/SQ IN |
| TENSILE STRENGTH ASTM METHOD D-1682 | | |
| CONTROL | 174 WARP 69 FILLING | 174 WARP 69 FILLING |
| AFTER NEUTRALIZATION | 119 WARP 46 FILLING | 128 WARP 44 FILLING |
| FABRIC PH | 9.1 | 7.4 |
| % PHOSPHORUS | | |
| BEFORE NEUTRALIZATION | 4.03 | 3.59% |
| AFTER NEUTRALIZATION | 2.38% | 2.59% |
| AFTER 10 WASHES AT 120° | 2.51% | 2.20% |
| AFTER 20 WASHES AT 120° | 2.49% | 2.23% |
| % PHOSPHORUS (avg. of two) | | |
| After Aging | 2.60 | 2.39 |
| After Aging & Wash | 2.60 | 1.99 |

EXAMPLES ( 14)–(17)

The following formulations were pad applied at 80–85% wet pickup, dried at 300° F. for two minutes and cured at 340_20 _0 F. for one minute.

Examples (14) and (16) represent formulations of this application. Examples (15) and (17) utilize a conventional D.P. resin.

| FORMULATIONS | (14) | (15) | (16) | (17) |
|---|---|---|---|---|
| KNITTEX PFR | — | 80 | — | 80 |
| AVIVAN PFS | 30 | 30 | 30 | 30 |
| DICRYLAN BSR | 40 | — | 40 | — |
| SCOTCHGARD STAIN-RELEASE FC-248 | 20 | 20 | 30 | 30 |

RESULTS

| Formulation | (14)[a] | (14)[b] | (15)[a] | (15)[b] | (16)[c] | (16)[d] | (17)[c] | (17)[d] |
|---|---|---|---|---|---|---|---|---|
| Oil Repellency | 5 | 3 | 3 | 4 | 3 | 3 | 3 | 2 |
| SOIL-RELEASE: | | | | | | | | |
| Stain-K | | | | | | | | |
| initial | 7 | 7 | 7 | 7 | 7 | 6 | 7 | 7 |
| 5 washes | 7 | 6 | 7 | 7 | 6 | 5 | 7 | 6 |

-continued

| | | | | | | | | |
|---|---|---|---|---|---|---|---|---|
| Stain-C | | | | | | | | |
| Initial | 7 | 7 | 4 | 4 | 6 | 7 | 7 | 6 |
| 5 washes | 7 | 5 | 3 | 3 | 6 | 6 | 6 | 6 |

[a]= bleached PES/CO (white)
[b]= dyed PES/CO (red)
[c]= bleached 100% cotton (white)
[d]= dyed 100% cotton (blue)

EXAMPLES (18)–(21 )

The following formulations are pad applied to PES/CO knit fabric to 50–60% pickup and then dried and cured at 325° F. for 2 minutes. All concentrations are in grams/liter.

| | (18) | (19) | (20) | (21) |
|---|---|---|---|---|
| SCOTCHGARD FC-248 | 20 | 20 | 20 | 20 |
| AVIVAN PFS | 30 | 30 | 30 | 30 |
| METHOCEL A15-LV at 10% | 100 | 400 | — | — |
| PLURONIC L-63 at 10% | — | — | 100 | 400 |

EXAMPLE (22)

The following comparative testing was carded out with formulations (A)–(E). Sample (A) represents an untreated control. Sample (B) utilizes a imidazolinone D.P. resin. Samples (C)–(E) utilize formulations of the present invention. All concentrations are in grams/liter.

| | (A) | (B) | (C) | (D) | (E) |
|---|---|---|---|---|---|
| SCOTCHGARD FC-248 | — | 20 | 20 | 20 | 20 |
| AVIVAN PFS | — | 30 | 30 | 30 | 30 |
| DICRYLAN BSR | — | — | 40 | — | — |
| METHOCEL A-15-LV at 10% | — | — | — | 100 | — |
| PLURONIC L-63 at 10% | — | — | — | — | 100 |
| KNITWX PFR | — | 50 | — | — | — |
| Application Conditions: | pad applied to 50/50 polyester/cotton knit fabric (double-dip/double-nip padding-Galtex laboratory padder model PA1) at 56% wet pick-up. Dried & cured in 1-step at 325° F. for 2 minutes. | | | | |

TEST RESULTS:

| | (A) | (B) | (C) | (D) | (E) |
|---|---|---|---|---|---|
| initial oil repellency:* | O | 1 | 2 | 2–3 | 2 |
| Stain-Release - initial: | | | | | |
| Stain K - | 4 | 7 | 7 | 7 | 7 |
| Stain C - | 5 | 5 | 7 | 6 | 6 |
| Stain-Release - 5 washes | | | | | |
| Stain K - | 4 | 7 | 6 | 5 | 5 |
| Stain C - | 5 | 6 | 6 | 6 | 7 |

*oil repellency is tested by 3M Oil Repellency Test I (3M Company bulletin), which is the same as AATCC 118-1983, wherein fabric samples are not pressed or ironed. O is the worst rating, and 8 is the best rating.

What is claimed is:

1. A method of finishing a textile which comprises imparting laundering durability to a performance-effect textile finish by applying the performance-effect textile finish to the textile by means of an aqueous finishing formulation which consists essentially of (a) an effective amount of a performance-effect textile finish selected from the group consisting of a soil-release agent, a soil repellant, a softener, a flame-retardant, an anti-static agent, and a light-stabilizer;

(b) a binder resin which is present in an amount sufficient to impart laundering durability to performance-effect textile finish, wherein said binder resin consists essentially of a non-formaldehyde-releasing, reverse-water-soluble polymer of the formula $$R-[NH-\overset{\overset{O}{\|}}{C}-O-(CH_2CH_2O)_n-(CH_2\underset{\underset{CH_3}{|}}{C}HO)_m-Z]_x$$

wherein R is the residue of an aliphatic or aromatic compound containing 3 or more reactive isocyanate groups; each Z is independently hydrogen, $C_1$-$C_8$-alkyl or an additional R group; x is 3 to 30, m is 0 to 100, and n is 5 to 500, which polymer has a cloud point between 20° C. and 60° C. and a solubility of at least it percent in water at 20° C.; and (c) a dispersant.

2. A method of claim 1 wherein the dispersant is a sodium salt of a naphthalene sulfonic acid condensate.

3. A method of claim 1 wherein the textile is selected from the group consisting of cotton, wool, polyester, nylon, acrylic, acetate and rayon.

4. A method of claim 1 wherein Z is $C_1$–$C_8$-alkyl.

5. A method of claim 4 wherein Z is butyl.

6. A method of claim 1 wherein the compound containing 3 or more isocyanate groups is of the formula

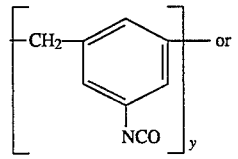

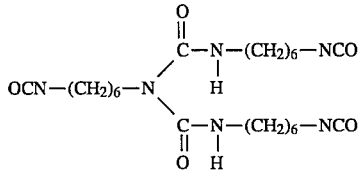

wherein y is 3 or greater.

7. A method of claim 6 wherein Z is butyl.

8. A method of claim 1 wherein the performance-effect textile finish is selected from the group consisting of an organophosphorous flame retardant and a fluorochemical soil-release agent.

9. A method of claim 7 wherein the performance-effect textile finish is selected from the group consisting of an organophosphorous flame retardant and a fluorochemical soil-release agent.

10. An aqueous finishing formulation which consists essentially of:

(a) 10–20 grams/liter of a reverse-water-soluble polymer of the formula $$R-[NH-\overset{\overset{O}{\|}}{C}-O-(CHCH_2O)_n-(CH\underset{\underset{CH_3}{|}}{C}HO)_m-Z]_x$$

wherein R is the residue of an aliphatic or aromatic compound containing 3 or more isocyanate reactive groups; each Z is independently hydrogen, $C_1$-$C_8$-alkyl or an additional R group; x is 3 to 30, m is 0 to 100, n is 5 to 500, with the proviso that the ratio of m to n is such that the polymer has a solubility of at least 1% in water at 20° C.;

(b) 40–400 grams/liter of a flame retardant; and (c) a dispersant.

11. An aqueous finishing formulation of claim 10 wherein the dispersant is a sodium salt of a naphthalene sulfonic acid condensate and is present at a concentration of from 03 to 0.6 grams/liter.

12. A finishing formulation of claim 10 wherein the flame-retardant is an organo-phosphorous type flame-retardant.

13. An aqueous finishing formulation which consists essentially of:

10–20 grams/liter of a reverse-water-soluble polymer of the formula $$R-[NH-\overset{\overset{O}{\|}}{C}-O-(CHCH_2O)_n-(CH\underset{\underset{CH_3}{|}}{C}HO)_m-Z]_x$$

wherein R is the residue of an aliphatic or aromatic compound containing 3 or more isocyanate; reactive groups;

each Z is independently hydrogen, $C_1$-$C_8$-alkyl or an additional R group; x is 3 to 30, m is 0 to 1130, n is 5 to 500, with the proviso that the ratio of m to n is such that the polymer has a solubility of at least 1% in water at 20° C.;

(b) 20–40 firms/liter of a fluorochemical soil-release agent;

(c) 0–40 grams/liter of a softening agent; and (d) a dispersant.

14. An aqueous finishing formulation of claim 13 wherein the dispersant is a sodium salt of a naphthalene sulfonic acid condensate and is present at a concentration of from 0.3 to 0.6 grams/liter.

15. An aqueous finishing formulation of claim 13 wherein said fluorochemical soil release agent is a perfluoroalkyl-acrylate-polyethylene oxide block copolymer.

* * * * *